US005312319A

United States Patent [19]

Salter

[11] Patent Number: 5,312,319

[45] Date of Patent: May 17, 1994

[54] CENTRIFUGE HAVING A SINGLE SWING ARM FOR RETAINING A STATOR TUBE

[75] Inventor: James R. Salter, The Woodlands, Tex.

[73] Assignee: Cobe Laboratories, Inc., Lakewood, Colo.

[21] Appl. No.: 80,133

[22] Filed: Jun. 23, 1993

Related U.S. Application Data

[63] Continuation of Ser. No. 875,323, Apr. 29, 1992, abandoned.

[51] Int. Cl.[5] ..... B04B 7/06

[52] U.S. Cl. ..... 494/12; 494/41; 269/45; 269/66; 269/268; 269/270

[58] Field of Search ..... 269/45, 66, 71, 126, 269/127, 254 CS, 265, 268, 270; 279/20, 145, 158; 494/12, 38, 41, 43, 84, 85

[56] References Cited

U.S. PATENT DOCUMENTS

| | | | |
|---|---|---|---|
| 273,578 | 3/1883 | Meyer | 494/84 X |
| 636,383 | 11/1899 | Hartmann et al. | 494/6 X |
| 917,123 | 4/1909 | Peck . | |
| 2,043,313 | 6/1936 | Wells | 494/84 X |
| 3,073,517 | 1/1963 | Pickels et al. | 494/12 X |
| 3,297,243 | 1/1967 | Hein | 494/43 |
| 3,317,127 | 5/1967 | Cole . | |
| 3,401,876 | 9/1968 | Lucas | 494/16 |
| 3,409,213 | 11/1968 | Latham, Jr. | 494/41 |
| 3,565,330 | 2/1971 | Latham, Jr. | 494/41 |
| 3,581,981 | 6/1971 | Latham, Jr. . | |
| 3,706,412 | 12/1972 | Latham, Jr. . | |
| 3,785,549 | 1/1974 | Latham, Jr. . | |
| 4,300,717 | 11/1981 | Latham, Jr. | 494/41 |
| 4,684,361 | 8/1987 | Feldman et al. . | |
| 4,692,136 | 9/1987 | Feldman et al. . | |
| 4,718,888 | 1/1988 | Darnell . | |
| 4,795,419 | 1/1989 | Yawn et al. . | |
| 5,045,048 | 9/1991 | Kaleskas et al. | 494/41 |
| 5,062,826 | 11/1991 | Mantovani et al. | 494/85 |

OTHER PUBLICATIONS

Electromedics the AT1000 Autotransfusion System with Pulse Wash, JAMA 1986.

Elmd-500 Transportable Autotransfusion System, Electromedics, Inc., date unknown.

*Primary Examiner*—Philip R. Coe
*Assistant Examiner*—Charles Cooley
*Attorney, Agent, or Firm*—Finnegan, Henderson, Farabow, Garrett & Dunner

[57] ABSTRACT

An apparatus for holding the stator of a vessel rotatable about an axis of rotation, includes a pivotable swing arm having a first end and a second end, the second end having an engagement portion for contacting the stator of a rotating vessel. A support is connected to the first end of the swing arm and has an axis spaced from and substantially parallel to the axis of rotation. The support cooperates with the swing arm to permit the swing arm to pivot toward and away from the stator. A detent finger, located in the swing arm cooperates with the stator to hold the stator against rotation when the swing arm is in a predetermined angular position, and maintains the stator in a fixed position relative to the swing arm during a centrifuge operation. Finally, a detent cam assembly resists pivotal movement of the swing arm when the swing arm is in the predetermined angular position.

23 Claims, 4 Drawing Sheets

FIG. 3a
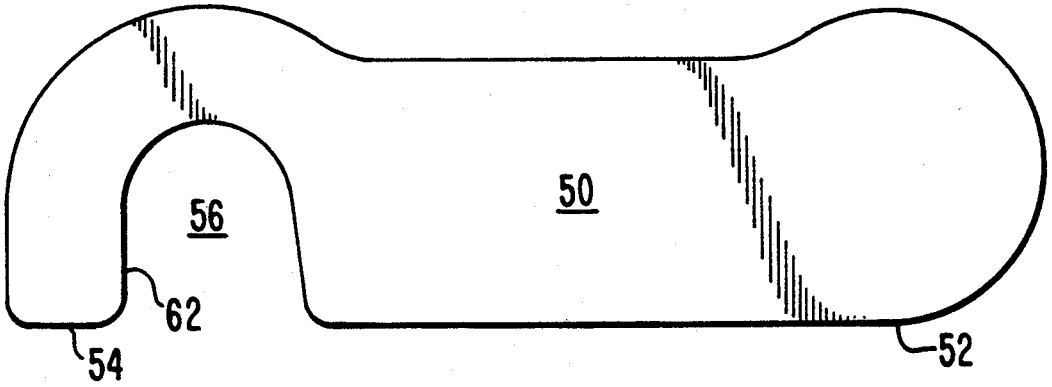
FIG. 3b
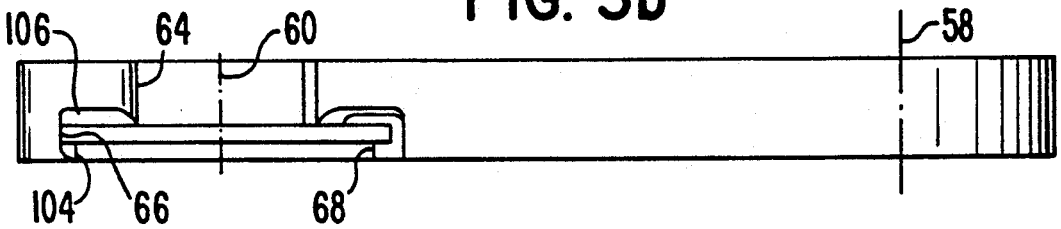
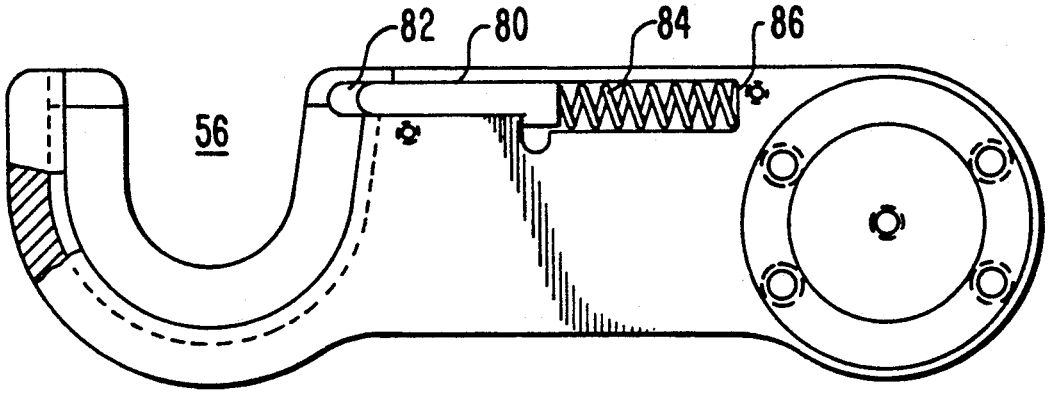
FIG. 3c

CENTRIFUGE HAVING A SINGLE SWING ARM FOR RETAINING A STATOR TUBE

This application is a continuation of application Ser. No. 07/875,323 filed Apr. 29, 1992, now abandoned.

BACKGROUND OF THE INVENTION

1. Field of the Invention

The present invention relates to centrifuges and more particularly to centrifuges having a structure for preventing rotation of the stator tube of a rotating vessel.

2. Description of the Related Art

U.S. Pat. No. 4,718,888 to Darnell, and U.S. Pat. Nos. 4,684,361 and 4,692,136 to Feldman et al., which are incorporated herein by reference, each disclose a centrifuge bowl having an attached dip tube assembly, for use in a centrifuge. The bowl is designed to hold liquids, and has a single opening at its upper end through which passes a stationary dip tube assembly (hereafter called the stator assembly). The stator has an inlet and outlet adjacent to the upper end for permitting liquid to be pumped into and pumped from the centrifuge during a centrifuge operation. A similar bowl/stator arrangement is shown in FIG. 1 of the present application and is typically used in connection with a centrifuge which rotates the bowl containing a liquid. When the bowl is rotated at sufficient speeds, fractions of the liquid may be separated. For example, when the liquid is human blood, a centrifuge operation may separate red blood cells from other components of the blood.

During a centrifuge operation using the above-described bowl and stator arrangement, the stator must be maintained in a position so that its inlet and outlet ports remain stationary. Rotational or lateral movement of the stator tube could cause tubes connected to the stator's ports to stretch and break thereby interrupting flow. Similarly, vertical movement of the stator could cause wear and/or destruction of the stator assembly.

Prior to the present invention, a typical centrifuge employed two swing arms to hold the stator in position. For example, U.S. Pat. No. 3,581,981 discloses a centrifuge chuck including two pivoting clamping arms each having an arcuate surface for holding the tube assembly therebetween. However, in the prior art, in order to properly engage the stator of the bowl/stator arrangement of the type shown in FIG. 1 of the present application, two pivoting arms must be moved, the face seal must be manually compressed, and a clamping device must be engaged and tightened. This is a two-handed operation that is difficult for a busy technician who may only have one hand to spare.

SUMMARY OF THE INVENTION

An object of the present invention is to provide a centrifuge apparatus for a bowl and a stator which may be engaged with and disengaged from the stator by a user using only a single hand.

Another object of the present invention is to provide a centrifuge apparatus that reduces the time required to install and remove a centrifuge bowl.

A further object of the present invention is to reduce the amount of steps necessary to install and remove a centrifuge bowl.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purposes of the invention, as embodied and broadly described herein, the invention comprises an apparatus for holding the stator of a vessel rotatable about an axis of rotation, the apparatus comprising a pivotable swing arm having a first end and a second end, the second end having an engagement portion for contacting the stator of a rotating vessel. Support means is connected to the first end of the swing arm and has an axis spaced from and substantially parallel to the axis of rotation. The support means cooperates with the swing arm to permit the swing arm to pivot toward and away from the stator. Holding means is provided and is solely located on the swing arm and pivotable therewith, for cooperating with the stator to hold the stator against rotation when the swing arm is in a predetermined angular position. The holding means also maintains the stator in a fixed position relative to the swing arm during a centrifuge operation.

The invention may include means for resisting pivotal movement of the swing arm when the swing arm is in the predetermined angular position. The swing arm may also include a ramped surface for engaging a portion of the stator and urging it in a downward direction toward the vessel when the swing arm is pivoted into position against the stator. In this manner, the effluent channel of the stator is urged away from the top of the bowl so that there is no friction during a centrifuge operation. With this arrangement, an operator can lock the stator into a fixed position in one step by merely pivoting the swing arm against the stator.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention, and together with the description, serve to explain the principles of the invention.

BRIEF DESCRIPTION OF THE DRAWINGS

FIGS. 3*a–c* illustrate the swing arm of the present invention wherein FIG. 3*a* is a top view, FIG. 3*b* is a side view, and FIG. 3*c* is a partially cross-sectioned bottom view of the swing arm;

FIG. 4*a–c* illustrate the swing arm assembly of the present invention, wherein FIG. 4*a* is a partially cross-sectioned side view, FIG. 4*b* is a bottom view, and FIG. 4*c* is a top view of the swing arm assembly;

DESCRIPTION OF THE PREFERRED EMBODIMENT

Figure 2:
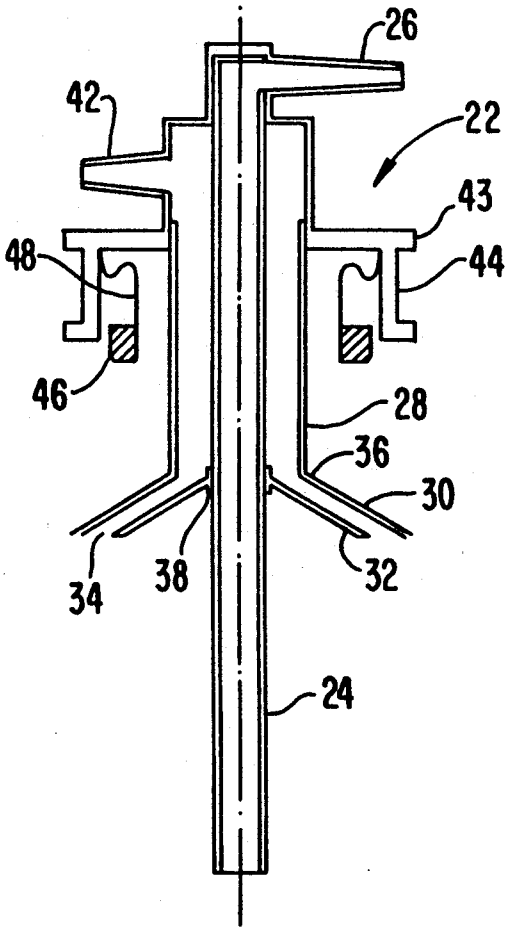
FIG. 2 is a cross-sectional view of the stator of FIG. 1.

Reference will now be made in detail to the present preferred embodiment of the invention, an example of which is illustrated in the accompanying drawings.

The present invention may be used in connection with the bowl and stator assembly illustrated in FIG. 1. Bowl 10 is rotatable about axis 11, and includes a bowl top 12 mounted on bowl bottom 14. A spacer 16 is located within the bowl, and a rotating face seal 20 is positioned about an opening 18 in the top of the bowl.

As illustrated in FIGS. 1 and 2, a stator assembly 22 is mounted in the opening 18 in the top of the bowl. Stator assembly 22 includes a fill/drain tube 24 that extends into the bowl to a position just above the bottom 14 of the bowl. Fill/drain tube 24 includes a laterally extending nozzle or port 26 located at a top end thereof. An effluent tube 28, having a diameter greater than that of the fill/drain tube 24, also extends through opening 18 into bowl top 12. Effluent tube 28 surrounds fill/drain tube 24 and extends into bowl 10 to a position beneath its opening 18. Two conical portions 30 and 32 are located within the bowl and together form an effluent channel 34 at the lower end of effluent tube 28. The narrow end of the first cone 30 includes an opening 36 having a diameter substantially equal to the diameter of the effluent tube 28. The bottom end of effluent tube 28 is connected to opening 36 of first cone 30. The second cone 32 has an opening 38 at its narrow end, for engaging the outer diameter of the fill/drain tube 24. Second cone 32 is spaced from first cone 30 relative to the central axis 11. Thus, a conical space exists between the first and second cones, thereby forming effluent channel 34. A nozzle or port 42 laterally extends from effluent tube 28, adjacent the upper end thereof and below nozzle 26.

A tubular bellows housing 44 is located about effluent tube 28 at a position above the top 12 of bowl 10. An annular face sea 46 is supported within the bellows housing 44 by an annular elastomer spring 48. The spring loaded annular face seal 46 is arranged to contact face seal 20 disposed about the opening 18 of bowl 10. The assembly of the two spring biased seals 20, 46 provides an air barrier between stator assembly 22 and bowl 10.

Figure 1A:
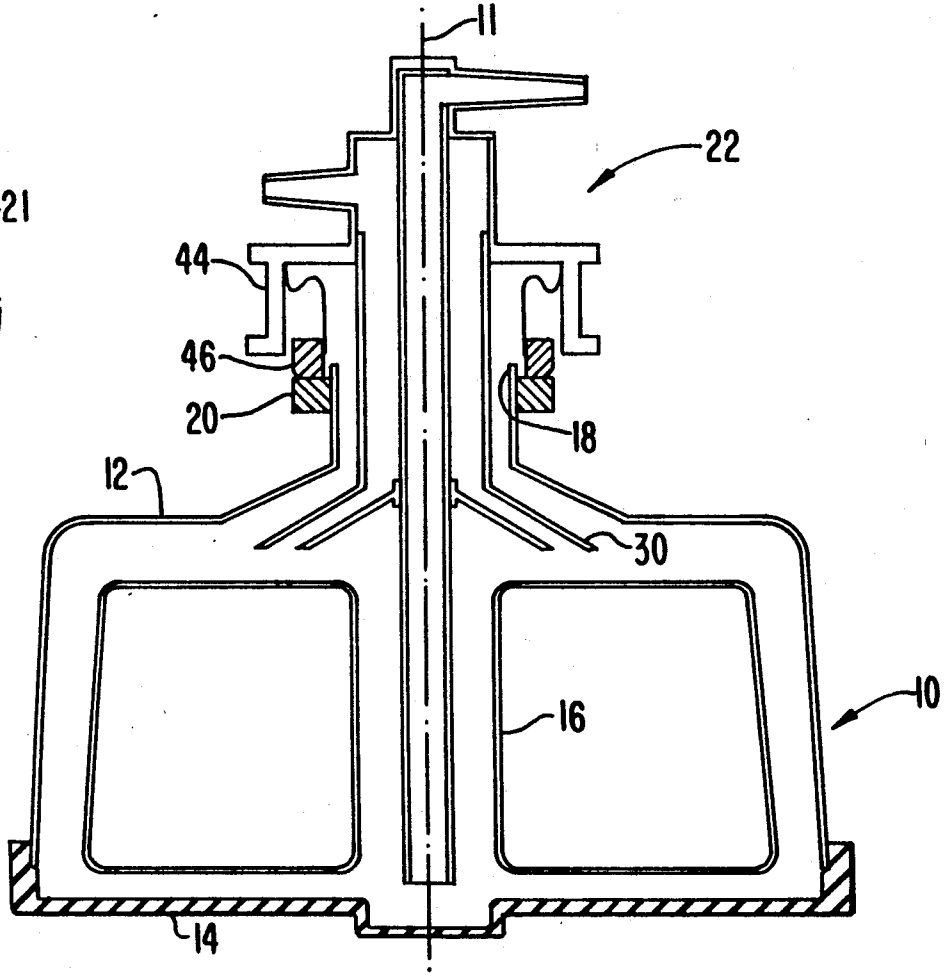
FIG. 1*a* is a cross-sectional view of a centrifuge bowl assembly for use in connection with the present invention.
Figure 1B:
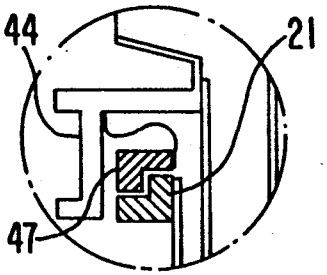
FIG. 1*b* is a partial cross-sectional view of an alternative sealing arrangement for the bowl assembly illustrated in FIG. 1*a*.

As illustrated in FIG. 1*a*, the contacting surfaces of the face seals 20, 46 may be planar. Alternatively, as illustrated in FIG. 1*b*, seals 20, 46 may include ribs 21, 47 for preventing lateral movement of the stator relative to the central axis of the bowl.

Prior to a centrifuge operation, stator assembly 22 is axially moved towards the bottom 14 of bowl 10. This serves two purposes. First, it effects a sealing force between face seals 20 and 46. In addition, it ensures that cone 30 of effluent channel 34 does not rub against the top 12 of bowl 10 when the bowl is rotated.

Figure 6B:
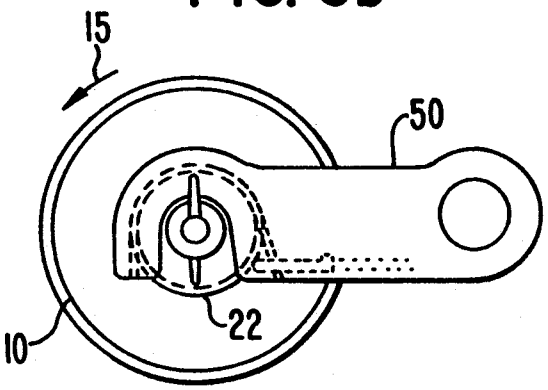
FIG. 6*b* is a partial top view of the swing arm apparatus shown in FIG. 6*a*.

The centrifuge of the invention rotates bowl 10 on turntable 108 via motor 13, in a direction as shown by arrow 15 in FIG. 6*b*. The invention holds stator assembly 22 in a fixed position against rotational, axial, and lateral movement in all directions as described below.

In accordance with the invention, the present invention includes a pivotable swing arm having a first end and a second end, the second end having an engagement portion for contacting the stator of a rotating vessel. As shown FIGS. 3*a–c*, swing arm 50 includes first end 52 and second end 54, and is pivotable about an axis 58 that extends through the first end 52. A cavity 56 is located in the second end 54 of the swing arm for engaging stator assembly 22.

Figure 6A:
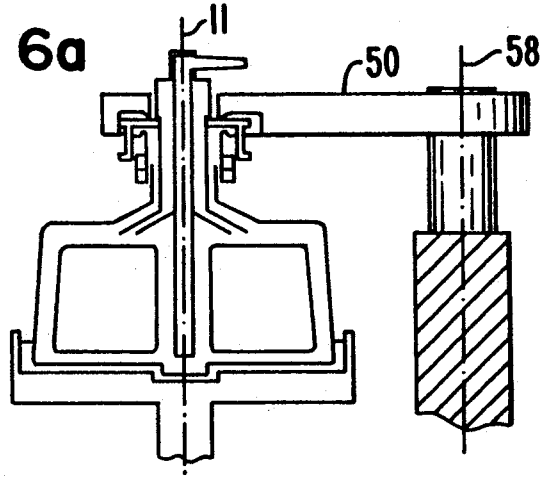
FIG. 6*a* is a partial cross-sectional view of the centrifuge apparatus of the present invention with the swing arm engaged with the stator.

Cavity 56 is substantially u-shaped and includes a central axis 60 and an edge region 62 disposed about axis 60. Edge region 62 includes a number of surfaces 64, 66, 68 spaced various distances from axis 60 in order to conform to the shape of stator assembly 22. For example, grooved surface 66 is shaped to conform to the dimensions of the flange 43 on the top of the bellows housing 44. This cavity traps the stator in a tongue-and-groove fashion as illustrated in FIG. 6*a*.

Figure 4C:
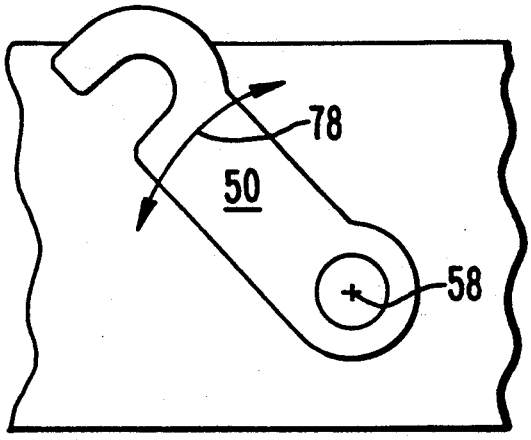
Figure 4A:
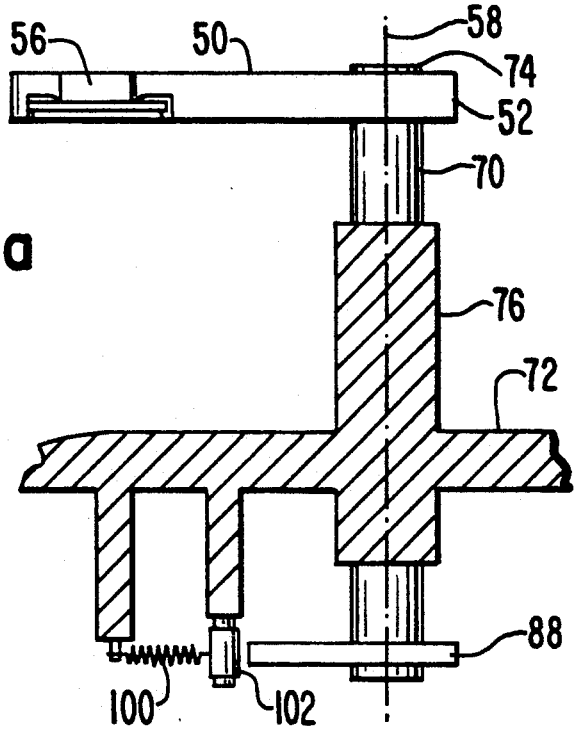

In accordance with the invention there is provided support means connected to the first end of the swing arm and having an axis spaced from and substantially parallel to the axis of rotation, the support means for cooperating With the swing arm to permit the swing arm to pivot toward and away from the stator. As shown in FIGS. 4*a* and 4*c*, the support means includes shaft 70 and chassis 72. Shaft 70 has a first end 74 fixed to the first end 52 of the swing arm 50 and is rotatable therewith. The chassis 72 includes a sleeve 76 for rotatably holding shaft 70. Bearings (not shown) may be anchored within the sleeve for reducing friction between the shaft 70 and the sleeve 76. The arrangement of the shaft 70 and sleeve 76 permits the swing arm to pivot as illustrated by arc 78 in FIG. 4*c*.

Also in accordance with the invention there is provided holding means, solely located on the swing arm and pivotable therewith, for cooperating with the stator to hold the stator against rotation when the swing arm is in a predetermined angular position, and for maintaining the stator in a fixed position relative to the swing arm during a centrifuge operation. As embodied herein, and as illustrated in FIG. 3*c*, the holding means includes detent finger 80 located in a bore 82 that extends through the edge region 62 of the cavity 56. A spring 84 is interposed between the detent finger 80 and an end 86 of the bore 82, in order to urge the detent finger 80 into the cavity 56.

Figure 5B:
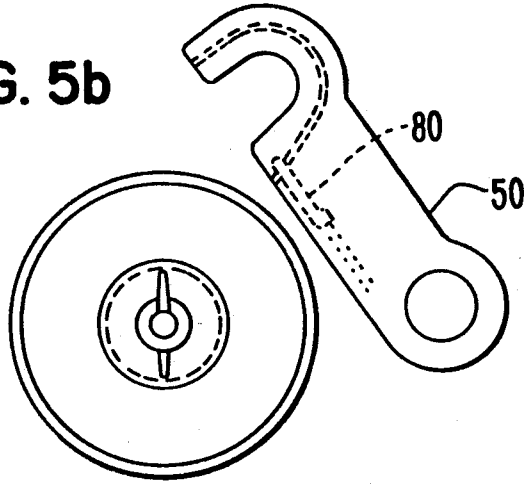
FIG. 5*b* is a top view of a portion of the centrifuge apparatus shown in FIG. 5*a*.
Figure 5A:
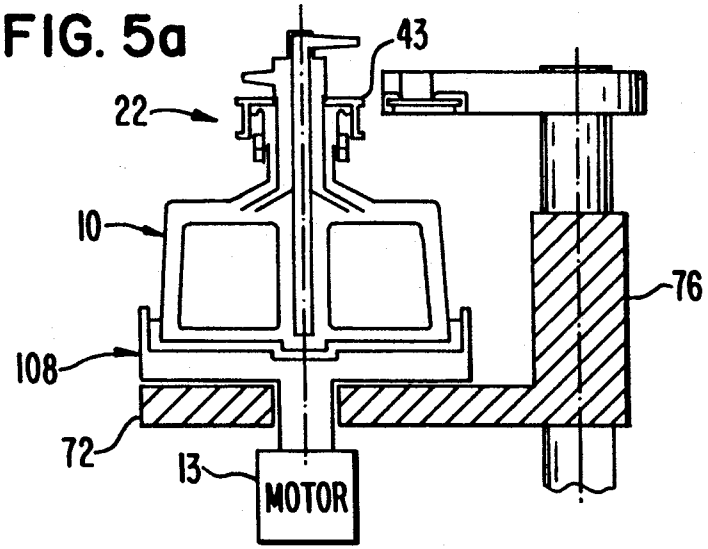
FIG. 5*a* is a cross-sectional view of the centrifuge apparatus of the present invention with the swing arm disengaged from the stator assembly.

Preferably, the detent finger is positioned to enter cavity 56 in a region near the open side edge of the u-shaped cavity 56. As illustrated in FIGS. 5*a* and 5*b*, with this arrangement, detent finger 80 engages stator assembly 22 at a location between the opened end of the cavity and the diameter of stator assembly 22. Further, the elongated axis of detent finger 80 is positioned relative to the Stator in a manner maximizing its holding ability.

When the swing arm is moved from a position not contacting the stator as shown FIGS. 5*a* and 5*b* to a predetermined angular position contacting stator assembly 22 as shown in FIGS. 6*a* and 6*b*, the detent finger 80 is compressed into bore 82 as it becomes aligned with the diameter of the stator assembly 22, and springs outward as the stator assembly 22 moves further into cavity 56. In this manner, detent finger 80 frictionally locks the stator assembly 22 within cavity 56, preventing rotational movement of stator assembly 22 as well as movement in any direction relative to the elongated axis of swing arm 50.

Figure 4B:
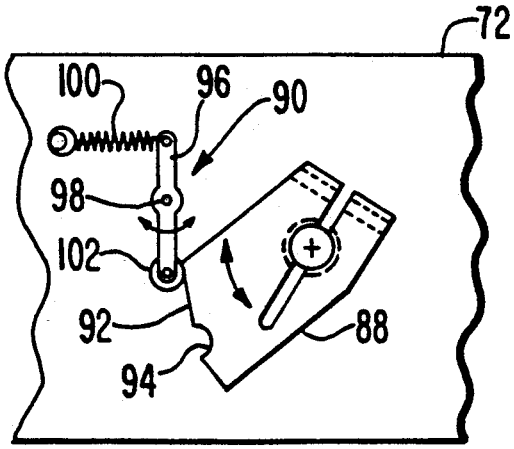

In accordance with the present invention there is provided means for resisting pivotable movement of the swing arm when the swing arm is in the predetermined angular position. As illustrated in FIGS. 4*a* and 4*b*, the resisting means includes detent cam 88 and cam follower mechanism 90. Detent cam 88 may be made of a piece of flat material having a cam surface 92 and an indented region 94 located on an edge thereof. The detent cam 88 is mounted on the bottom of shaft 70, and is rotatable therewith.

Cam follower mechanism 90 includes a lever arm 96 having a cam following roller 102 disposed at one end and a spring 100 connected to an opposite end. The lever arm 96 is connected to chassis 72 and pivots about an axis 98 located between the ends of the lever. As the swing arm 50 is pivoted toward a predetermined angular position, cam following roller 22 rolls along cam surface 92 of detent cam 88. Spring 100 urges roller 102 against cam surface 92. When the swing arm reaches the predetermined angular position, roller 102 enters groove 94 and remains in the groove due to the force exerted on lever arm 96 by spring 100.

If bottom 14 of bowl 10 is anchored to turntable 72, and if face seal ribs 21, 47 are used, as illustrated in FIG. 1*b*, the resisting means of the present invention may not be required. This is because ribs 21 and 47 prevent lateral movement of the stator assembly 22 relative to bowl 10. Thus, once the holding means engages the stator, the arm is prevented from moving laterally by a combination of the holding means and the interconnection of ribs 21 and 47.

The present invention may also includes means connected to the swing arm for urging at least a portion of the stator in a direction toward the vessel as the swing arm is pivoted into the predetermined angular position. As embodied herein, and as illustrated in FIGS. 3*b* and 3*c*, the urging means includes ramped surface regions 104 and 106 located in the edge region 62 of cavity 56. As the swing arm contacts the bellows housing 44 of stator assembly 22, the bellows housing 44 climbs the ramped surface regions and is thereby urged downward towards the bottom 14 of bowl 10, against the force of elastomer spring 48. This serves two purposes. First, as bellows 44 moves downward, the face seal 46 of the stator assembly 22 is urged against the rotation face seal 20 of the bowl 10. In addition, the downward movement of the stator tube ensures that the effluent channel 34 does not rub against the inside of the bowl 10 as the bowl rotates.

Operation of the invention will now be described. As illustrated in FIGS. 5*a* and 5*b*, a bowl 10, and interconnected stator tube 22 is placed on a rotatable turntable 108. An operator then swings the arm 50 into engagement with the stator assembly 22 as shown in FIGS. 6*a* and 6*b*. As thearm 50 moves into the predetermined radial position shown in FIGS. 6*a* and 6*b*, three things occur substantially simultaneously. First, as the diameter of the bellows housing 44 passes detent finger 80, the finger 80 moves into cavity 56 to prevent the stator assembly 22 from rotating about axis of rotation 11. The detent finger 80 cooperates with the edge region 62 of cavity 56 to prevent the stator from moving in any lateral direction relative to the arm.

Second, and as discussed earlier, the ramped surface regions 104 and 106 located along the edge region 62 of cavity 56 urges the stator tube to move downward as the swing arm is moved to the predetermined angular position.

Finally, when the swing arm reaches the predetermined angular position, cam following roller 102 enters groove 94 of detent cam 88, as illustrated in FIG. 4*b*, in order to lock the swing arm against pivotal movement about axis 58. Thus, with a single pivotal movement, the swing arm 50 is locked into a predetermined radial position, the stator is rotationally and laterally locked into position, and the stator is moved downward.

In order to remove the bowl and stator assembly from turntable 108, an operator need only pivot swing arm 50 away stator assembly 22 with a force sufficient to overcome the holding force caused by springs 100, 84, and 48. Therefore, with the structure of the present invention, an operator may engage and disengage a stator in a single step using a single hand.

Other embodiments of the invention will be apparent to those skilled in the art from consideration of the specification and practice of the invention disclosed herein.

For example, the invention may be practiced by mounting the swing arm 50 on a nonrotatable shaft so long as the swing arm is rotatable on the shaft. In addition, other structure may be used as the holding means in place of detent finger 80. For example, the edges 62 of cavity 56 may be sized to hold stator assembly 22 merely by a friction fit, or a magnetic holding device may be used. Therefore, it is intended that the specification and examples be considered as exemplary only, with a true scope and spirit of the invention being indicated by the following claims.

What is claimed is:

1. An apparatus for holding a stator of a vessel rotatable about an axis of rotation during a centrifuge operation, the apparatus comprising:

a swing arm pivotable about a pivot axis and having a first end and a second end, the second end having an engagement portion configured to engage the stator of a rotating vessel;

support means connected to the first end of the swing arm and having an axis spaced from and substantially parallel to the axis of rotation, the support means for supporting the swing arm in a manner permitting the swing arm to pivot toward and away from the stator;

holding means, located on the swing arm and pivotable therewith, for cooperation with the stator to hold the stator against rotation when the swing arm is in a predetermined angular position, and for maintaining the stator in a fixed position relative to the swing arm during a centrifuge operation; and spring biased means for resisting pivotal movement of the swing arm in response to a predetermined rotational force about the pivot axis applied to the swing arm, the spring biased resisting means including means for responding to a rotational force about the pivot axis which is greater than the predetermined rotational force to permit pivotal movement of the swing arm.

2. An apparatus according to claim 1 wherein the resisting means resists pivotal movement of the swing arm when the swing arm is in the predetermined angular position.

3. An apparatus according to claim 2 wherein the means for resisting pivotal movement of the swing arm includes an indented surface region coupled to the swing arm and a resilient member for entering the indented surface region when the swing arm is in the predetermined angular position.

4. An apparatus according to claim 2 wherein the support means includes a shaft connected to and rotatable with the swing arm, and the means for resisting pivotal movement of the swing arm includes a detent cam located on the shaft and a spring biased cam follower for engaging the cam in a locking manner when the swing arm is in the predetermined angular position.

5. An apparatus according to claim 1 wherein the engagement portion includes a cavity shaped to conform with a shape of the stator.

6. An apparatus according to claim 5 wherein the means for holding the stator includes a spring biased detent finger located in an edge of the cavity.

7. An apparatus according to claim 5 wherein the means for holding the stator includes a groove disposed along an edge region of the cavity for engaging a portion of the stator in a tongue-in-groove manner.

8. An apparatus according to claim 1 wherein the support means includes a shaft connected to the swing arm.

9. An apparatus according to claim 8 wherein the shaft is rotatable together with the swing arm.

10. An apparatus according to claim 1 further including means connected to the swing arm for urging at least a portion of the stator in a direction toward the vessel as the swing arm is pivoted into the predetermined angular position.

11. An apparatus according to claim 10 wherein the urging means includes a ramped surface located at the second end of the swing arm.

12. An apparatus according to claim 1 wherein the stator includes a spring loaded face seal selectively movable against a seal of the vessel, the swing arm including means for urging the spring loaded face seal against the seal of the vessel as the swing arm is pivoted into the predetermined angular position.

13. An apparatus according to claim 12 wherein the urging means includes a ramped surface located at the second end of the swing arm.

14. An apparatus for rotating a vessel while holding a stator in a stationary position, the apparatus comprising:

a base having a rotatable turntable mounted thereon, the turntable configured to rotate the vessel about an axis of rotation;

a rotatable shaft spaced from and extending substantially parallel to the axis of rotation, the shaft having a first end rotatable on the base, and a second end;

a swing arm pivotable about a pivot axis and having a first end and a second end, the first end of the swing arm being connected to the second end of the shaft, and the second end of the swing arm having an engagement portion for contacting the stator of the vessel;

holding means, located on the swing arm and pivotable therewith, for cooperating with the stator to hold the stator against rotation about the axis of rotation when the swing arm is in a predetermined angular position, and for maintaining the stator in a substantially fixed position relative to the swing arm during a centrifuge operation; and spring biased means for resisting pivotal movement of the swing arm in response to a predetermined rotational force about the pivot axis applied to the swing arm, the spring biased resisting means including means for responding to a rotational force about the pivot axis which is greater than the predetermined rotational force to permit pivotal movement of the swing arm.

15. An apparats according to claim 14, wherein the spring biased resisting means, has a portion located on the shaft, for resisting pivotal movement of the swing arm when the swing arm is in the predetermined angular position. resisting pivotal movement of the swing arm when the swing arm is in the predetermined angular position.

16. An apparatus according to claim 15 wherein the resisting means includes a detent cam located on the first end of the shaft and a spring biased cam follower for engaging the cam in a locking manner when the swing arm is in the predetermined angular position.

17. An apparatus according to claim 14 wherein the engagement portion includes a cavity shaped to conform with a shape of the stator.

18. An apparatus according to claim 17 wherein the means for holding the stator includes a spring biased detent finger located along an edge of the cavity.

19. An apparatus according to claim 17 wherein the holding means includes a groove disposed along an edge region of the cavity for engaging a portion of the stator in a tongue-and-groove manner.

20. An apparatus according to claim 14 further including means connected to the swing arm for urging at least a portion of the stator in a direction toward the vessel as the swing arm is pivoted into the predetermined angular position.

21. An apparatus for rotating a vessel while holding a stator in a stationary position, the apparatus comprising:

a base having a rotatable turntable mounted thereon, the turntable configured to rotate the vessel about an axis of rotation;

a pivotable swing arm having a first end and a second end, the second end having an engagement portion for contacting the stator of the rotating vessel;

support means for connecting the base and the swing arm in a manner permitting the swing arm to pivot toward and away from the stator;

holding means, located on the swing arm and pivotable therewith, for holding the stator against rotation when the swing arm is in a predetermined angular position, resisting means, having a portion fixed to the support means for resisting a predetermined rotational force applied to the swing arm when the swing arm is in the predetermined angular position, the resisting means permitting pivotal movement of the swing arm in response to a force, applied to the swing arm, greater than the predetermined force; and means, located at the engagement portion of the swing arm, for urging at least a portion of the stator in a direction toward the vessel as the swing arm is pivoted into the predetermined angular position.

22. An apparatus according to claim 21 wherein the urging means includes a ramped surface located on the second end of the swing arm.

23. An apparatus for holding a stator of a vessel rotatable about an axis of rotation during a centrifuge operation, the apparatus comprising:

a swing arm pivotable about a pivot axis and having a first end and a second end, the second end having an engagement portion configured to engage the stator of the rotatable vessel;

support means connected to the first end of the swing arm and having an axis spaced from and substantially parallel to the axis of rotation, the support means for supporting the swing arm in a manner permitting the swing arm to pivot toward and away from the stator;

holding means, located on the swing arm and pivotable therewith, for cooperating with the stator to hold the stator against rotation when the swing arm is in a predetermined angular position, and for maintaining the stator in a fixed position relative to the swing arm during a centrifuge operation; and spring biased means for exerting a predetermined resist force to resist pivotal movement of the swing arm, the spring biased means including means for responding to a rotational force applied about the pivot axis to the swing arm that is greater than the predetermined resist force to permit the swing arm to pivot.

* * * * *

UNITED STATES PATENT AND TRADEMARK OFFICE

CERTIFICATE OF CORRECTION

PATENT NO. : 5,312,319

DATED : May 17, 1994

INVENTOR(S) : James R. Salter

It is certified that error appears in the above-indentified patent and that said Letters Patent is hereby corrected as shown below:

Claim 1, column 6, line 46, change "cooperation" to --cooperating--.

Claim 15, column 8, line 3, change "apparats" to --apparatus--;

lines 4 and 5, delete each occurrence of ",";

line 7, after "position.", delete the rest of the line;

lines 8 and 9, delete in their entirety.

Claim 21, column 8, line 44, change "position," to --position;--.

Signed and Sealed this

Sixth Day of September, 1994

*Attest:*

*Attesting Officer*

BRUCE LEHMAN

*Commissioner of Patents and Trademarks*